United States Patent [19]

Soble

[11] 4,007,568

[45] Feb. 15, 1977

[54] FOUNDATION FOR MODULAR BUILDINGS

[76] Inventor: Bernard D. Soble, 19151 Berkley, Detroit, Mich. 48221

[22] Filed: Mar. 10, 1975

[21] Appl. No.: 556,969

[52] U.S. Cl. ..... 52/294; 52/126; 52/298

[51] Int. Cl.[2] ..... E02D 27/00

[58] Field of Search ..... 52/294, 299, DIG. 11, 52/23, 298, 143, 126, 122, 259

[56] References Cited

UNITED STATES PATENTS

| | | | |
|---|---|---|---|
| 3,364,636 | 1/1968 | Salsig, Jr. | 52/122 X |
| 3,708,931 | 1/1973 | Button | 52/143 X |

*Primary Examiner*—Price C. Faw, Jr.
*Assistant Examiner*—Carl D. Friedman
*Attorney, Agent, or Firm*—Krass & Young

[57] ABSTRACT

A foundation for securely retaining a factory built structure, such as a mobile home, modular building, or the like, having an underframe including a pair of steel beams, to a land site. The foundation includes a concrete pad with a pair of recesses for containing the axles attached to the underside of the building frame. The pad has cylindrical concrete piers extending through its surface at spaced intervals forming two lines spaced at the same distance as the beams of the underframe. Central cylindrical cavities are formed in each of the piers and are adapted to receive cylinders which extend downwardly from the underside of the frame beams. The undersides of the beams rest on the top surfaces of the piers and downturned flanges attached to the frame beams surround the sides of the piers and restrain the structure against lateral movement.

2 Claims, 8 Drawing Figures

FIG. 1
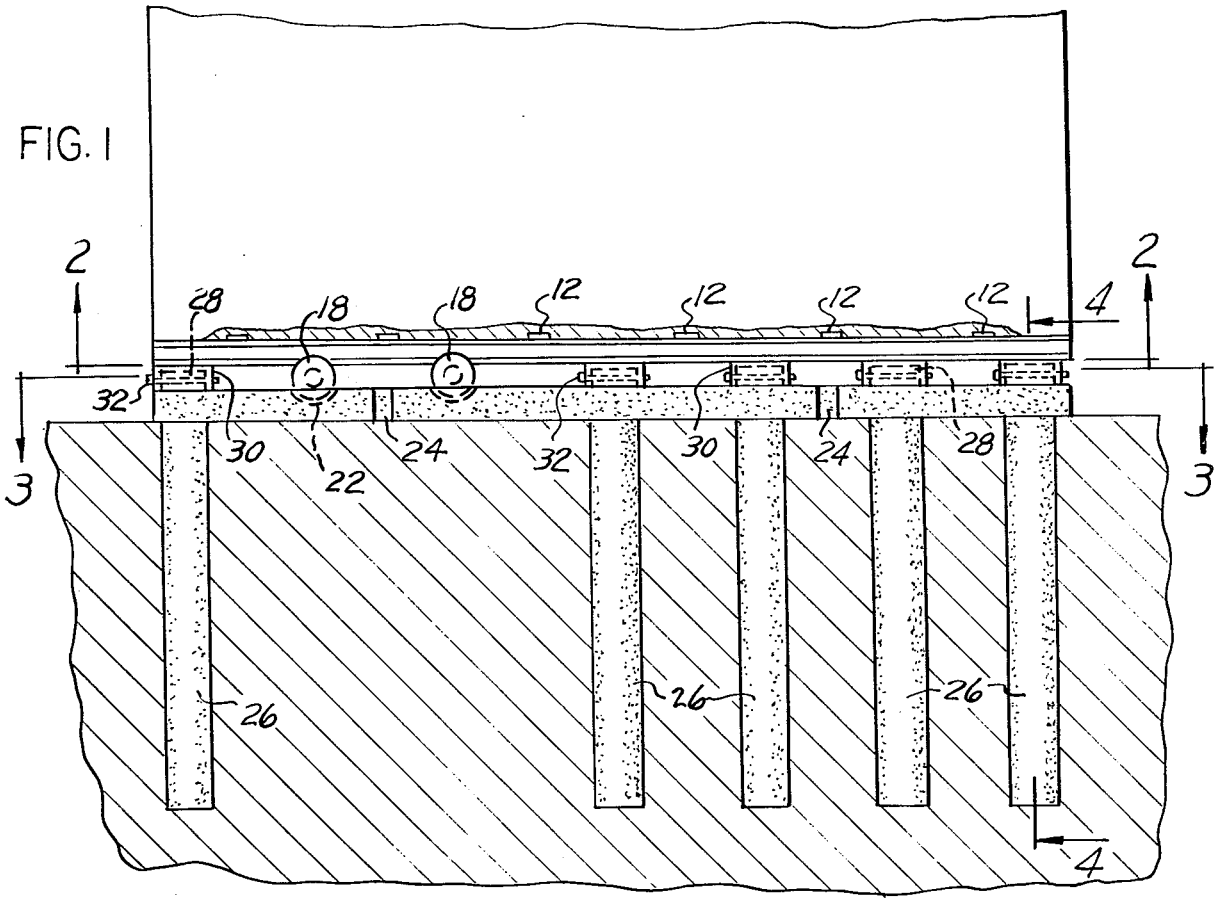
FIG. 2
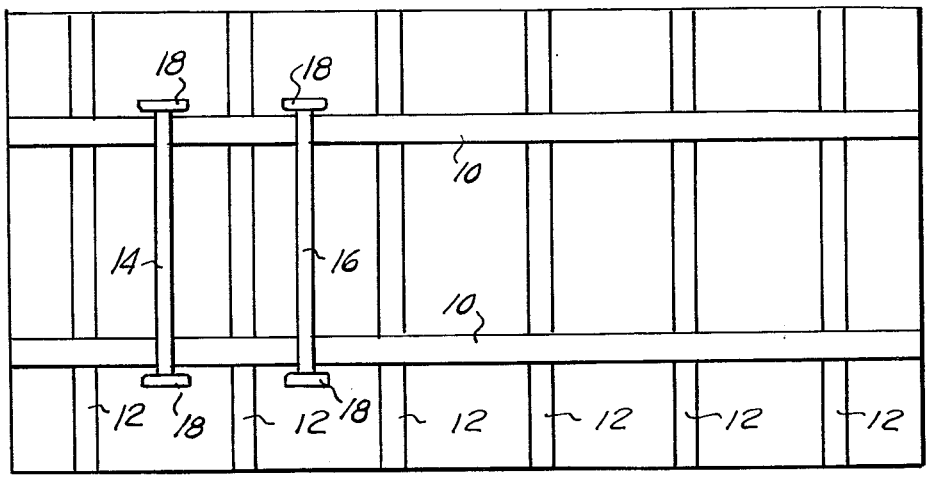
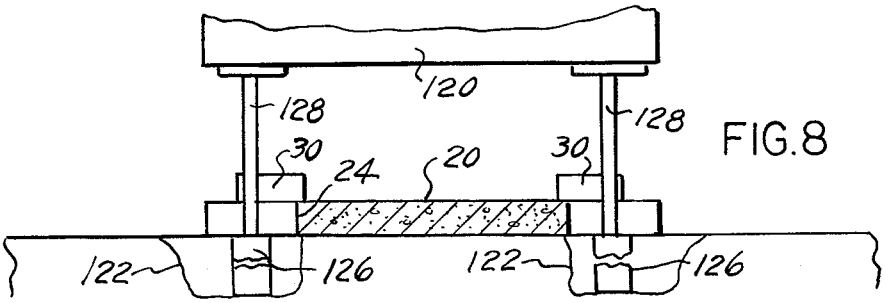
FIG. 8

FIG.3
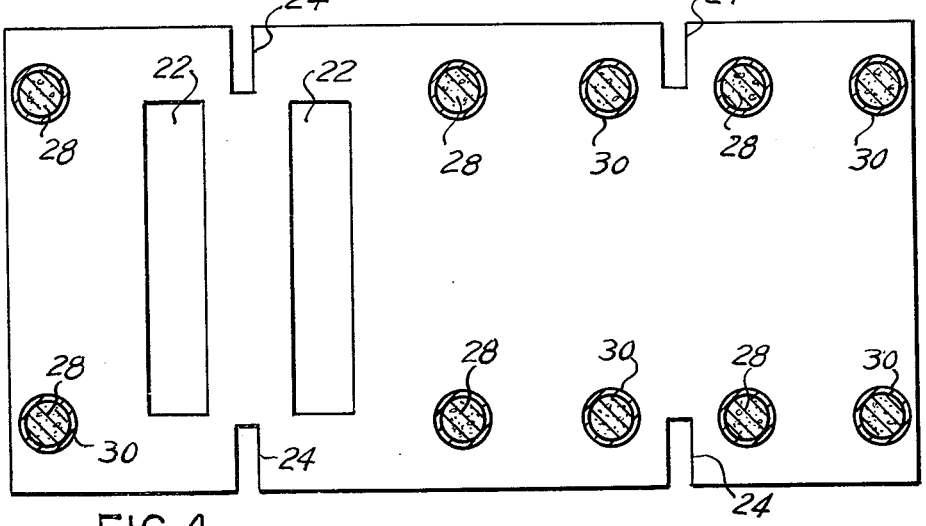
FIG.4
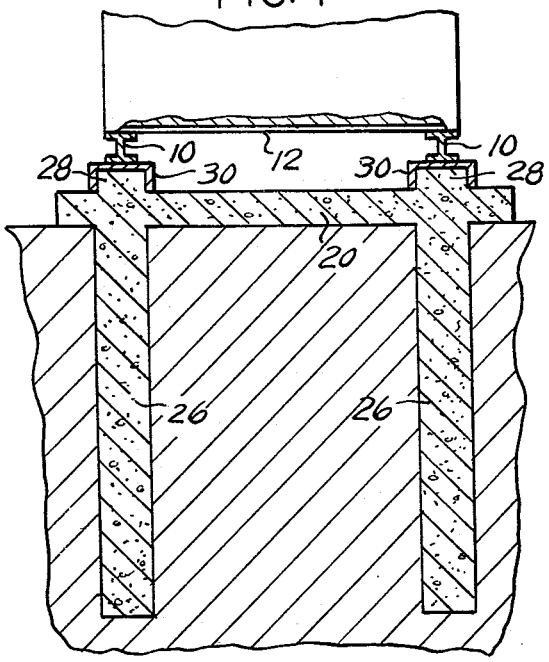
FIG.5
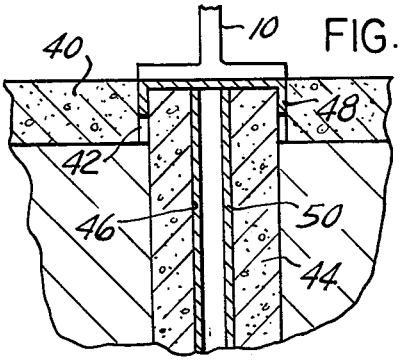
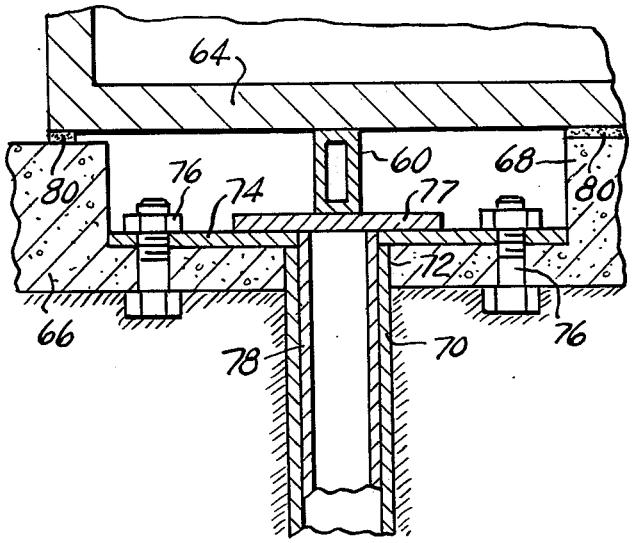
FIG.6
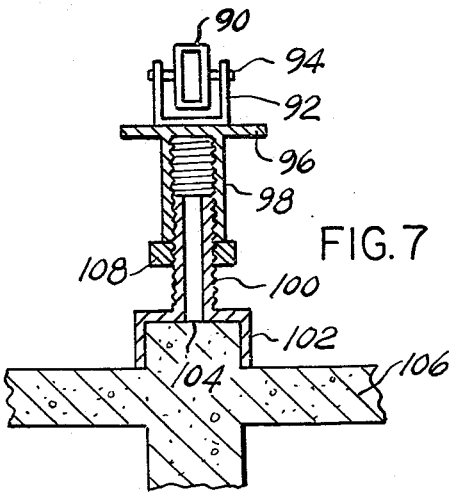
FIG.7

FOUNDATION FOR MODULAR BUILDINGS

BACKGROUND OF THE INVENTION

1. Field of the Invention

This invention relates to a foundation arrangement for securing a factory built structure having an underframe including steel beams, to a land site, and more particularly to such an arrangement which includes a concrete pad having pier structures adapted to support the beams.

2. Prior Art

Mobile homes and offices, recreational vehicles, and like factory built modular structures, hereinafter termed "modular buildings" generally employ underframes constructed about a pair of parallel spaced steel beams extending the length of the unit. The building's wheels are supported on axles which may be permanently or temporarily affixed under these frame members. When the buildings are to be permanently or semi-permanently located at a site they are jacked up to raise them off the wheels and piles of concrete blocks or the like are stacked under the frame members and the unit is then lowered onto these stacks. Various forms of tie-down straps may be secured in the surrounding soil or to an underlying concrete pad and joined to the frame to secure the unit against dislodgement from the frame supports under forces imposed by wind and the like. The piles of blocks are often hidden from view by skirts extending between the edges of the underside of the unit and the ground or pad.

These foundation arrangements were developed when mobile homes were seldom retained at a site for longer than a single season. Modern mobile homes are typically only mobile for the short period of time required to move them from a factory or sales lot to a permanent building site. In these relatively permanent structures such makeshift foundation arrangements are far from satisfactory. First, they are usually not very secure and the mobile homes frequently tip over in high winds. Second, in order that the axles may clear the ground the units must be elevated so that the door sills are high above the ground and stairs must be provided to these doors. Finally, the arrangement is often unsightly with the space between the pad and the building used for storage of miscellaneous objects.

SUMMARY OF THE INVENTION

The present invention contemplates a foundation arrangement for such buildings which allows the beams forming the central part of the underframe to be securely retained to a concrete pad formed on the home site which strongly resists forces which would tend to overturn the unit. The unit is positioned with its underframe faced immediately above the concrete pad eliminating the need for extensive skirting or high step arrangements. The resulting structure is more physically attractive than units formed according to the prior art arrangements.

In accordance with the present invention structures are formed between the concrete pads and the beams of the mobile home's underframe to permanently secure the two together to resist upward displacement of the house from the pad as well as to vertically support the structure on the pad.

These fastening structures include a plurality of piers formed through the concrete pads and extending substantially below the pad below the freeze line. The piers may be formed of concrete or of steel or composition tubes and are preferably arrayed in two lines along the length of the pad spaced at the same distance as the beams forming the central part of the underframe of the building structure. The upper surfaces of the piers are preferably separated from the adjacent surfaces of the pad by a vertical shoulder. This vertical shoulder may be formed by either elevating or depressing the upper surfaces of the piers with respect to the adjacent surfaces of the pad or by forming a circular cavity between the adjacent surfaces of the piers and the pads.

The piers may have central vertical cavities formed downwardly from their flat top ends. Mating concrete or steel cylinders are affixed to the undersides of the frame members and adapted to project into the cavities in the piers. Downturned flanges affixed to the frame members around the cylinders engage the sides of the piers adjacent to their top.

An alternate form of fastener member for joining the steel beams to the pier tops includes a pair of cylindrical sections threaded to one another so that the length of the section may be adjusted. One end is affixed to the beam and the other end rests on the top of the pier.

The pads are preferably formed with voids or recesses adapted to receive axle structures which may be attached to the mobile homes or the like so that the underframes may lie in close spaced relationship to the surface of the pad, eliminating the necessity for extensive skirting or step arrangements. The pads may also be formed with recesses to receive jacks that can be used to support the mobile structures while their wheels are removed, and to lower them into engagement with the piers and pads.

Other objectives, advantages and applications of the present invention will be made apparent by the following detailed description of several preferred embodiments of the invention. The description makes reference to the accompanying drawings in which:

FIG. 1 is an elevational view through a mobile building structure supported on a foundation arrangement formed in accordance with a first embodiment of the present invention;

FIG. 2 is an upward view through the underframe structure of the mobile home taken along line 2—2 of FIG. 1;

FIG. 3 is a downward sectional view taken along line 3—3 of FIG. 1 and illustrating the upper surface of the pad;

FIG. 4 is a sectional elevational view taken along line 4—4 of FIG. 1 showing the end view of the pier structure of FIG. 1;

FIG. 5 illustrates an alternative form of pier structure wherein the upper surfaces of the piers are substantially level with the adjacent surface of the pad;

FIG. 6 is a sectional view through still another form of pier structure wherein the piers are formed of tubes having their lower ends depressed with respect to the adjacent surface of the pad;

FIG. 7 is a sectional view through an alternate form of adjustable length coupling mechanism; and FIG. 8 is a sectional view through the jack receiving recesses of the pad illustrating the manner in which the mobile home structure is lowered onto the pad.

As has been noted, the foundation arrangement of the present invention may be used with mobile homes and like modular buildings. The invention is hereinafter described in connection with a mobile home, but that mobile home is to be considered merely representative of the broader class of modular buildings.

A mobile home, as illustrated in FIG. 1, with a portion of its side broken away to illustrate the structure of the frame, employs a pair of elongated steel beams or tubes 10 which are disposed parallel to one another and extend the full length of the modular building. These beams are illustrated in FIGS. 1, 2 and 4 as being I-beams, but alternatively could have other cross-sectional configurations, such as a channel, box or the like. The I-beams 10 are typically disposed with their flanges aligned horizontally and their web extending vertically.

The frame of FIGS. 1, 2 and 4, the I-beams are connected to regularly spaced laterally extending frame members 12 welded or otherwise fastened across the top flanges of the I-beams 10. The frame may have front and rear axle housings 14 and 16 connected to the I-beams and extending below them, carrying wheel hubs 18 at their outer ends. The wheels of the mobile structure may be removed from the housing when the unit is affixed to a building site.

The foundation arrangement includes a flat rectangular concrete pad 20 having longitudinal and lateral dimensions which are at least equal to and preferably exceed those of the modular building structure. The pad may typically have a thickness of from 5 to 10 inches. The pad is preferably formed with a pair of spaced semi-cylindrical recesses 22 extending laterally across the pad and adapted to receive the axle structure 14 and 16 of the mobile home so that these may lie below the pad surface and allow the underframe member to be supported in close proximity to the pad surface.

The pad is also preferably formed with a number of slotted recesses 24 extending inward laterally from the side edges of the pad 20. Four of the recesses are illustrated in FIGS. 1 and 3, but larger numbers of these recesses may be alternatively provided. These recesses are adapted to support jacks for use in lowering a modular building structure onto the supporting foundation in a manner which will be subsequently described.

The pad is formed with a plurality of downwardly extending piers 26 arranged in two rows. In the preferred embodiment of the invention the piers are formed of the same concrete material as the pad 20 and are formed integrally with the pad adjacent to their upper ends. The piers extend substantially below the bottom surface of the pad, preferably to below the frost line in the Northern climates, and may typically have a depth of 42 inches. The number of piers used will be dependent upon the length of the pad structure and the largest load that may be imposed on the structure, but typically the pads will be spaced on approximately 5-10 foot centers so that from 5 to 10 of the piers might be used for a 60 foot long pad. The spacing between the two rows of piers is the same as the spacing between the two longitudinal beams 10 of the underframe.

The upper surfaces of the piers 26 extend above the top level of the pad 20 forming raised cylindrical caps 28. These caps may typically project from 4 to 6 inches above the top surfaces of the pad.

In order to secure the underframe to the pads, cylindrical, downwardly dished steel fastener members 30 are welded or otherwise attached to the undersides of the lower flanges of the beams 10 at spaced intervals which coincide with the spacing between the piers 26. The inner diameters of the fasteners 30 exceed the outer diameters of the upper ends 28 of the piers so that the fasteners may extend over the piers and effectively cap them. The flat underside of the fastener lies in abutment to the upper surface of the pier and the inner diameters of the downturned flanges extend over the sides of the pier.

In this relationship the axle housings 14 lie in the recesses 22, allowing the underframe to be supported above the surface of the pad by a distance equal to the height of the pier tops 28.

The underframe of the modular structure is thus supported at a number of spaced points so that its weight is relatively evenly distributed and does not impose any particular forces on the relatively thin pad 20. The downturned flanges of the fastener members 30 support the modular building against lateral displacing forces such as wind and the like. Pin members 32 may be extended horizontally through holes formed in the fasteners 30 and complementary holes formed in the pier tops 28. Alternatively, lag bolts could be fastened into the concrete of the pier top through holes formed in the fasteners 30.

FIG. 5 illustrates an alternative form of pier and fastener arrangement. A pad 40 is formed with a plurality of circular apertures 42 through which concrete piers 44 are separately formed. The upper surfaces of the piers may be level with or slightly below the adjacent surface of the pad 40 and a cylindrical vertically extending slot separates the two. This slot may be formed by an appropriate mold used to cast the pier 42.

The piers 44 each have a central cavity 46 which extends downwardly from their upper ends. The cavity 46 may extend through the full length of the pier or may terminate short of the bottom. A cylindrical dished fastener 48 with downwardly directed flanges is welded to the lower flange of the beam 10 and extends over the top of the pier 44 with the flanges extending into the cylindrical slot between the pier and the adjacent pad surface. The fastener 48 has a cylindrical steel tube 50 welded to its underside and projecting downwardly. This tube fits within the central cavity 46 formed in the pier 44 and acts as an additional stabilizing element. Various forms of horizontal pin arrangements may be used to secure the fasteners 48 to the pier top. This arrangement allows even closer spacing between the underframe and the pad surface since the bottom surface of the flanges may lie directly in abutment to the pad surface.

Another pier arrangement is illustrated in the drawing of FIG. 6. The modular building is illustrated as having longitudinal frame members consisting of box sections 60 secured to laterally extending frame members 64.

The concrete pad 66 is formed with a plurality of depressed cylindrical sections 68 and tubular piers 70 extend through apertures 72 in the central section of each depressed area and project substantially below the bottom of the pad structure. The tube 70 may be formed of steel or alternatively a cast or molded concrete or composition material.

The upper end of each of the tubes 70 is formed with a horizontal flange 74 which lies in abutment to the bottom of the cylindrical depression 68. Nut and bolt fasteners 76 pass through holes formed in the flange 74 and through mating holes in the bottom surface of the pad beneath the recess 68 to secure the tubes in position.

The fastener for joining the underframe to the pad and pier structure includes a disc-like plate 77 welded to the underside of the box beam 60 and having a steel tube 78 welded to its underside and projecting vertically below the disc. The outer diameter of the tube 78 is complementary to the inner diameter of the pier tube 70 and the two are arranged coaxially. Appropriate gaskets 80 of a resilient material may be formed between the underside of the mobile structure and the adjacent upper surface of the pad 66 to form a watertight seal therebetween.

An alternate embodiment of fastener member is illustrated in FIG. 7. While this fastener is specifically designed for use with a pad of the type illustrated in FIG. 1, having a raised pier surface extending above the adjacent pad surface, similar fasteners could be used with the pier embodiments of FIGS. 5 and 6.

The fastener of FIG. 7 is illustrated as attached to a box beam 90 forming one of the longitudinal beams of the modular building underframe. A trunion fastener 92 straddles the box section 90 and is connected thereto by a pin 94 which may be welded to the box or simply inserted through holes in the box. A disc-shaped plate 96 is welded to the underside of the trunion mount 92 and has a downwardly extending internally threaded tubular member 98 formed integrally therewith. An externally threaded tube member 100 is affixed to the upper side of downwardly dished cap fastener 102 and makes a threaded engagement with the tube 98. Thus the length of the fastener between the upper surface 104 of a pier formed in a pad 106 and the longitudinal beam 90, may be adjusted. A lock nut 108 may be used to secure the mating threaded sections 98 and 100 in their adjusted position.

FIG. 8 illustrates the manner in which jacks may be inserted in the recesses 24 formed laterally inwardly from the sides of the pad 20 in order to lower a modular building structure 120 onto a suitable pier surface. Trenches 122 may be formed in the supporting soil surface beneath the recesses 24 and jack members 126 having extensible rod members 128 may be slipped into the recesses 24 and the trenches 122 on the laterally outer sides of the pads. The jacks may be extended so as to support the modular building, while its wheels are removed, and allow it to be slowly lowered so that the appropriate fastener members attached to the underframe are secured to the piers.

Alternatively, a conventional sling arrangement may be placed under the mobile home and supported with jacks disposed outside of the pad area to lower the building into place.

The foundation arrangement thus described is accordingly relatively simple in form and securely retains modular buildings in a permanent fashion.

Having thus described my invention, I claim:

1. A foundation for retaining a modular building having an underframe employing a pair of elongated steel beams, comprising: a concrete pad having a horizontal surface with dimensions at least equal to the dimensions of the underside of the building; concrete piers formed through the pad and extending downwardly from the lower surface of the pad, said piers being arranged in two rows spaced from one another by the same distance as the steel beams of the building; first cylindrical steel tubes supported centrally through each pier, and with the upper end of each tube substantially flush with the upper surface of the pad, the lower end of each tube being disposed substantially below the lower surface of the pad; a plurality of second steel tubes having outer dimensions complementary to the inner dimensions of the first steel tubes so that the second steel tubes may telescope within said first steel tubes; and means for securing one end of each of the second steel tubes to the underside of the steel beams so that the second steel tubes telescope within the first steel tubes and allow vertical motion of the modular building relative to the pad while restraining horizontal movement.

2. The foundation of claim 1 including means adapted to be secured to the second steel tubes and supported in abutting relationship to the surface of the pad surrounding said piers to maintain the modular building in an elevated relationship with respect to the pad.

* * * * *